United States Patent [19]

Weber

[11] Patent Number: 4,584,941

[45] Date of Patent: Apr. 29, 1986

[54] INK DUCT FOR PRINTING PRESSES

[75] Inventor: Werner Weber, Sandhausen, Fed. Rep. of Germany

[73] Assignee: Heidelberger Druckmaschinen AG, Heidelberg, Fed. Rep. of Germany

[21] Appl. No.: 708,713

[22] Filed: Mar. 6, 1985

[30] Foreign Application Priority Data

Mar. 6, 1984 [DE] Fed. Rep. of Germany ..... 3408183

[51] Int. Cl.[4] ..... B41F 31/00

[52] U.S. Cl. ..... 101/350; 101/365

[58] Field of Search ..... 101/363, 364, 365, 207, 101/208, 350

[56] References Cited

U.S. PATENT DOCUMENTS

| | | | |
|---|---|---|---|
| 3,135,197 | 6/1964 | Dutro et al. | 101/364 |
| 3,339,485 | 9/1967 | Rytterholm | 101/364 X |
| 4,165,688 | 8/1979 | Leanna et al. | 101/207 |
| 4,361,089 | 11/1982 | Wittkopf et al. | 101/207 X |
| 4,366,754 | 1/1983 | Sarda | 101/208 |

FOREIGN PATENT DOCUMENTS

| | | | |
|---|---|---|---|
| 238756 | 8/1925 | United Kingdom | 101/208 |
| 819276 | 9/1959 | United Kingdom | 101/364 |

*Primary Examiner*—Edgar S. Burr
*Assistant Examiner*—Moshe I. Cohen
*Attorney, Agent, or Firm*—Herbert L Lerner; Laurence A. Greenberg

[57] ABSTRACT

An ink duct for a printing press having an ink knife forming a bottom part thereof which is adjustably movable relative to an ink-duct roller, respective ink-duct jaws being disposed at opposite sides of the ink knife and defining therewith and with the ink-duct roller an inner space for receiving a supply of ink therein includes a sealing surface formed on the ink-duct jaws for sealing the ink-duct jaws with the cylindrical surface of the ink-duct roller, the sealing surface being a surface in contact with the cylindrical surface of the ink-duct roller and having a width equal to part of the width of the respective ink-duct jaw, the contact surface having a spiral construction with respect to the ink-duct jaw so that a trailing end of the contact surface, as viewed in rotary direction of the ink-duct roller, faces towards the inner space of the ink duct.

3 Claims, 5 Drawing Figures

INK DUCT FOR PRINTING PRESSES

The invention relates to an ink duct for printing presses and, more particularly, to such an ink duct having an ink knife forming a bottom part thereof which is adjustably movable relative to an ink-duct roller, respective ink-duct jaws being disposed at opposite sides of the ink knife and defining therewith and with the ink duct roller an inner space for receiving a supply of ink therein.

A general problem with ink ducts is that of effecting a suitable sealing of the sides or end faces thereof against leakage to prevent ink from escaping from the interior thereof and fouling the inking unit. The sealing per se occurs either with respect to the cylindrical surface of the ink-duct roller or at the sides or end faces. Both types of construction offer advantages but have the distinct disadvantage that the sealing problem has not yet been solved satisfactorily.

In a heretofore known construction disclosed in German Petty Patent (DE-GM) No. 1 855 128, an ink-duct jaw is shown which is sealed towards the side or end of the ink-duct roller. With such a jaw, ink travels between the ink-duct roller and the sealing surface as a result of capillary action and, due to the rotation of the ink-duct roller, forms a thin ink film on the latter. After a brief period of time, due to the displacement of the ink on the outside of the ink-duct jaw, a bead of ink is produced which can then drip off. This disadvantage is also unable to be avoided by pressing the ink-duct jaw more tightly against the ink-duct roller because this causes the formation of harmful frictional heat which alters the consistency of the ink.

It is accordingly an object of the invention to provide an ink duct for printing presses wherein the sealing of the ink-duct jaws is improved over that of heretofore known ink ducts, and wherein ink escaping from the ink supply due to leakage is returned thereto, thereby avoiding fouling of the inking unit.

With the foregoing and other objects in view, there is provided, in accordance with the invention, an ink duct for a printing press having an ink knife forming a bottom part thereof which is adjustably movable relative to an ink-duct roller, respective ink-duct jaws being disposed at opposite sides of the ink knife and defining therewith and with the ink-duct roller an inner space for receiving a supply of ink therein, comprising a sealing surface formed on the ink-duct jaws for sealing the ink-duct jaws with the cylindrical surface of the ink-duct roller, the sealing surface being a surface in contact with the cylindrical surface of the ink-duct roller and having a width equal to part of the width of the respective ink-duct jaw, the contact surface having a spiral construction with respect to the ink-duct jaw so that a trailing end of the contact surface, as viewed in rotary direction of the ink-duct roller, faces towards the inner space of the ink duct.

In accordance with an added feature of the invention, the contact surface extends at an inclination to the respective ink-duct jaw.

In accordance with a concomitant feature of the invention, the ink-duct jaws are formed of wear-resistant elastic material.

An advantage of this construction according to the invention is that the relatively narrow contact surface provides an improved sealing action and, due to the spiral or helical construction of the contact surface, the ink film remaining at the trailing end of the contact surface on the ink-duct roller reaches the ink supply again within the contact surface after only one rotation of the ink-duct roller and is mixed in with the ink supply. For this purpose, the trailing ends of the contact surfaces on the ink-duct jaws at both sides of the ink duct extend towards the inside or inner space of the ink duct.

Other features which are considered as characteristic for the invention are set forth in the appended claims.

Although the invention is illustrated and described herein as embodied in an ink duct for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
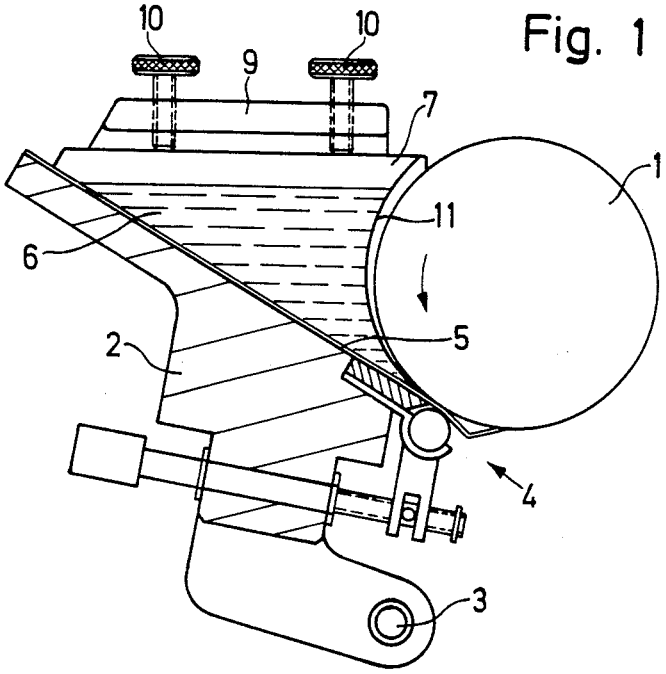
FIG. 1 is a cross-sectional view of an ink duct for printing presses constructed in accordance with the invention.

Referring now to the drawing and first, particularly, to FIG. 1 thereof, there is shown therein an ink-duct roller 1 adjacent to an ink duct 2 which is pivotable away from the ink-duct roller 1 about a pivot pin 3, which may be suitably attached to a side frame 8 (FIG. 2) of a printing press. An ink metering device 4 serves, in a conventional manner, to form an ink film on the ink-duct roller 1. The ink metering device 4 is covered by a foil 5 to prevent contamination on an ink supply 6 received in the ink duct 2. Ink-duct jaws 7 are provided at opposite sides of the ink duct 2, only one of the ink-duct jaws 7 being shown in FIG. 1 coextensive with the plane of the drawing.

Figure 2:
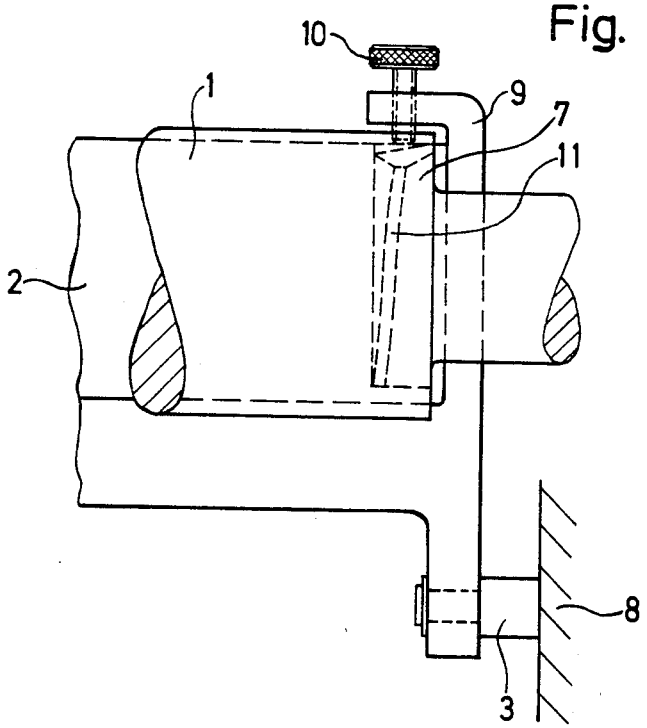
FIG. 2 is a fragmentary elevational view of FIG. 1 as seen from the right-hand side of FIG. 1.
Figure 3:
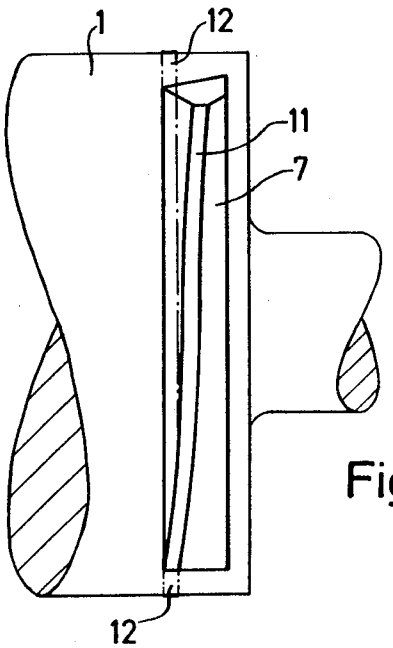
FIG. 3 is an enlarged, fragmentary view of FIG. 2 showing an ink-duct jaw forming part of the invention.

From FIG. 2, it is to be understood that the ink duct 2 is mounted by the pins or bolts 3 (only one of which is shown) on both sides thereof to the side frames 8 (only one of which is shown) of the printing press. The ink-duct roller 1 likewise is journalled at both ends thereof in the opposite side frames 8. The ink-duct jaw 7 is held in contact with a lower part of the ink duct 2 and with the cylindrical surface of the ink-duct roller 1 by means of a side bar or plate 9 provided on the ink duct 2, and by means of clamping screws 10. Contact surfaces 11 are provided on the ink-duct jaws 7 as sealing surfaces with respect to the ink-duct roller 1, the contact surfaces 11, as shown in FIGS. 2 and 3, for example, having only part of the width of the ink-duct jaw 7 and being spirally shaped relative thereto. In a similar manner, it is also possible to construct the relatively narrow contact surface 11 so that it extends at an inclination to the main body of the ink-duct jaw 7.

In FIG. 3, an enlarged view of the ink-duct jaw 7 with the relatively narrow contact surface 11 is presented, from which it is apparent that the lower, trailing end of the contact surface 11 i.e. as viewed in direction of rotation of the ink-duct roller 1 (note the curved arrow in FIG. 1), faces towards the inside of the ink duct 2 i.e. towards the ink supply 6. The effect thereof is that the thin ink film 12 (shown in broken lines in FIG. 3) located between the contact surface 11 and the ink-duct roller 1, and which is transferred to the ink duct roller 1 at the lower end of the contact surface 11, reaches the upper end of the contact surface 11 after one revolution of the ink-duct roller 1, the ink film being offset towards the inside with respect to the contact surface 11, and thus reaches the supply of ink provided there. The possibility of even a small amount of ink escaping from the ink duct is thereby excluded with the ink duct construction according to the invention.

Figure 4:
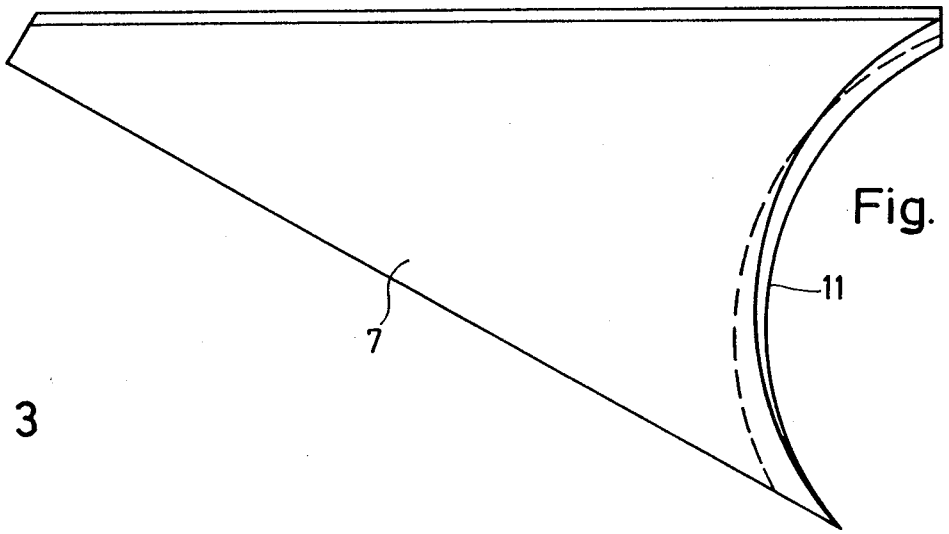
FIG. 4 is a side elevational view of the ink-duct jaw of FIG. 3.
Figure 5:
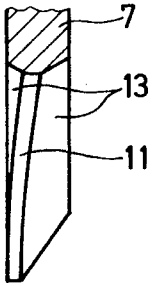
FIG. 5 is a fragmentary view, partly in section, of the ink-duct jaw as shown in FIG. 3.

In the side view of the ink-duct jaw 7 according to FIG. 4, the spiral or helical construction of the contact surface 11 is also shown. FIG. 5 shows the construction of the narrow contact surface 11 at the lower end thereof, both inclined sides 13 of the ink-duct jaw 7 on opposite sides of the narrow contact surface 11 being visible. The ink-duct jaw 7 shown in the figures is preferably formed of a wear-resistant elastic material which may be a synthetic material, for example.

The foregoing is a description corresponding in substance to German Application No. P 34 08 183.6, dated Mar. 6, 1984, the International priority of which is being claimed for the instant application, and which is hereby made part of this application. Any material discrepancies between the foregoing specification and the aforementioned corresponding German application are to be resolved in favor of the latter.

I claim:

1. Ink duct for a printing press having an ink knife forming a bottom part thereof which is adjustably movable relative to an ink-duct roller, respective ink-duct jaws being disposed at opposite sides of the ink knife and defining therewith and with the ink-duct roller an inner space for receiving a supply of ink therein, comprising a sealing surface formed on the ink-duct jaws for sealing the ink-duct jaws with the cylindrical surface of the ink-duct roller, said sealing surface being a surface in contact with the cylindrical surface of the ink-duct roller and having a width equal to part of the width of the respective ink-duct jaw, said contact surface having a spiral construction with respect to said ink-duct jaw so that a trailing end of said contact surface, as viewed in rotary direction of the ink-duct roller, faces towards the inner space of the ink duct.

2. Ink duct according to claim 1 wherein said contact surface extends at an inclination to the respective ink-duct jaw.

3. Ink duct according to claim 1 wherein the ink-duct jaws are formed of wear-resistant elastic material.

* * * * *